US005806260A

United States Patent [19]

Quaintance

[11] Patent Number: 5,806,260

[45] Date of Patent: Sep. 15, 1998

[54] RESTAURANT AND HOTEL COMBINATION

[75] Inventor: Dennis W. Quaintance, Greensboro, N.C.

[73] Assignee: Quaintance-Weaver Hotels, L.L.C., Greensboro, N.C.

[21] Appl. No.: 719,725

[22] Filed: Sep. 25, 1996

[51] Int. Cl.[6] ..... E04H 3/04

[52] U.S. Cl. ..... 52/236.3; 52/79.8; 52/234; 25/4

[58] Field of Search ..... 52/79.1, 79.7, 52/79.8, 234, 236.3, 236.4, 238.1, 169.1, 169.2, 36.1, 34; D25/4

[56] References Cited

U.S. PATENT DOCUMENTS

| | | | |
|---|---|---|---|
| 3,346,997 | 10/1967 | Parrish | D25/4 X |
| 3,479,781 | 11/1969 | Johnson | D25/4 X |
| 3,742,932 | 7/1973 | Greenspan | 52/234 X |
| 3,862,525 | 1/1975 | Greenspan | 52/234 X |
| 4,745,719 | 5/1988 | Blankstein et al. | 52/234 |
| 4,879,850 | 11/1989 | Glassco et al. | 52/82 |

FOREIGN PATENT DOCUMENTS

| | | | |
|---|---|---|---|
| 0258836 | 8/1988 | Germany | 52/234 |
| 2243879 | 9/1990 | Japan | 52/234 |

*Primary Examiner*—Christopher Kent
*Assistant Examiner*—Yvonne Horton-Richardson
*Attorney, Agent, or Firm*—Rhodes, Coats & Bennett, L.L.P.

[57] ABSTRACT

A restaurant and hotel combination including a restaurant structure and a hotel structure. The restaurant structure includes a dining area and defines a substantially rectangular restaurant footprint. The hotel structure includes a lobby area and a plurality of guest rooms. The hotel structure defines a substantially rectangular hotel footprint. Each of the restaurant and hotel footprints has exactly one respective corner thereof overlapping the respective corner of the other. An overlap area is thereby defined and is positioned within each of the restaurant and hotel footprints. Preferably, the overlap area is no greater than 30% of the restaurant footprint.

20 Claims, 3 Drawing Sheets

100C
104
100b
100d
102
101
10
100
22
207
112
203
201
205
20
212
104
100a
105
200C
103
200d
110
107
200b
200
21
210
202
200a
204

FIG. 3
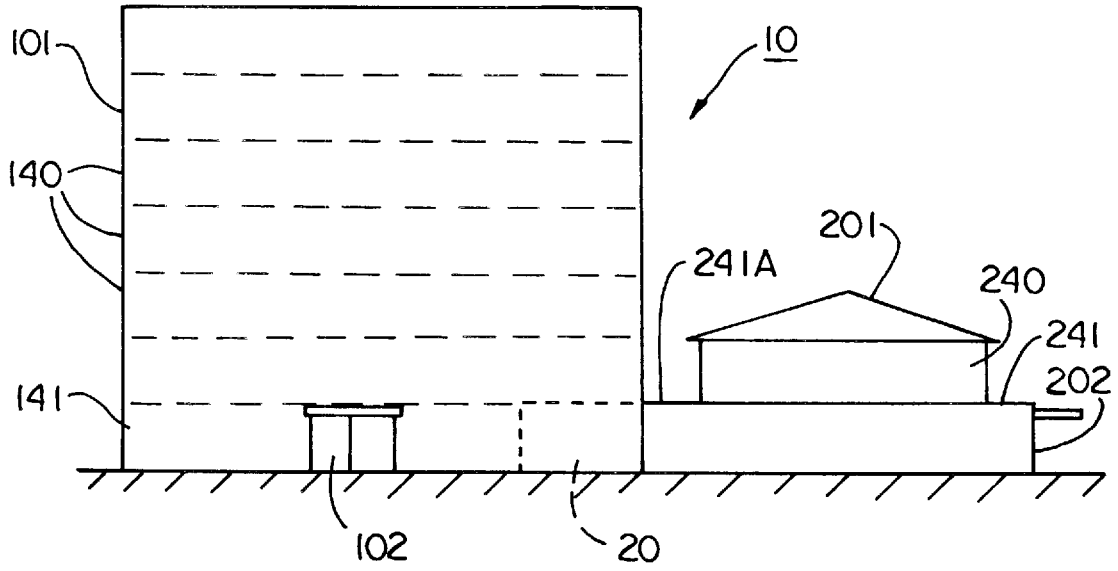
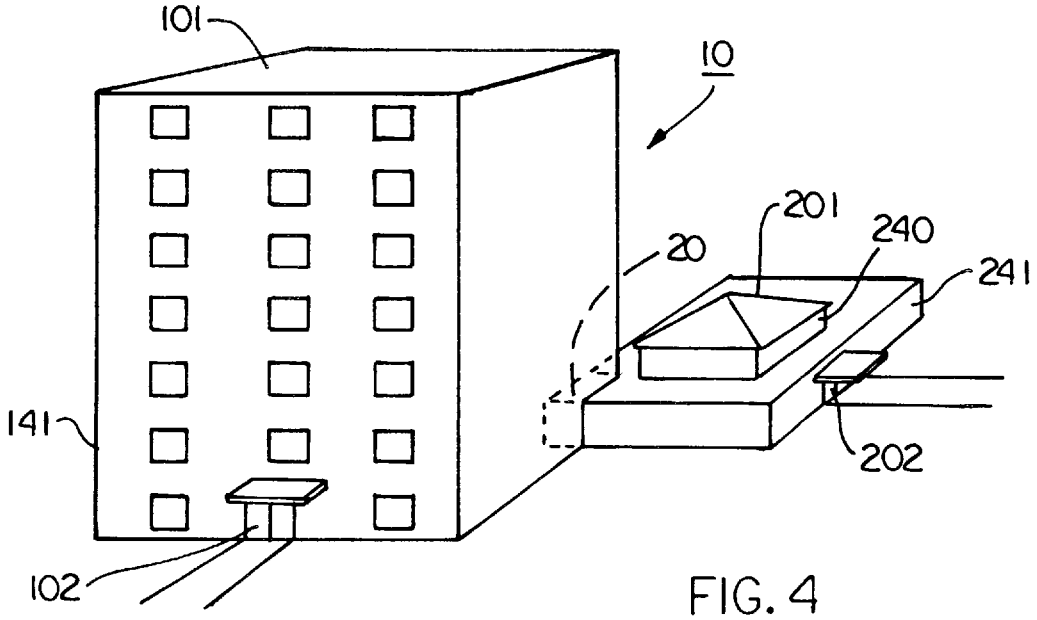
FIG. 4

RESTAURANT AND HOTEL COMBINATION

FIELD OF THE INVENTION

The present invention is directed to restaurant structures and hotel structures, and, more particularly, to a restaurant and hotel combination having a restaurant structure and a hotel structure which are joined together, but which gives the impression that the structures are separate and distinct structures.

BACKGROUND OF THE INVENTION

It has long been known that having upscale food service in a nice hotel is a significant advantage because it is an attractive amenity. Guests are inclined to stay at such hotels because the quality food service enhances the convenience and overall quality of their stay. The provision of upscale food service in a hotel also is advantageous because of the "unit economics" that exist when the hotel and restaurant share the land and development costs plus the enhancement of having banquet service. Moreover, hotel occupancy (and therefore potential restaurant patronage from the hotel) is typically high early in the week whereas local patronage of the restaurant is typically high only near or during the weekend.

Unfortunately, for several reasons, the current paradigm is: "Hotel restaurants are not good." On the one hand, guests of the hotel often seek food elsewhere, assuming that the hotel restaurant is so poor, relative to other restaurants, that the inconvenience of seeking food elsewhere is justified. On the other hand, non-guests of the hotel (e.g., local residents) tend to avoid the hotel restaurant, thereby severely limiting the market and traffic for the hotel restaurant. This is a well known and much discussed problem in the hotel industry.

Thus, there exists a need for a hotel and restaurant combination design which provides the advantages of a combined hotel and restaurant, but which gives the impression that the hotel and restaurant are separate. In this way, guests of the hotel will recognize the convenience of the nearby restaurant, while patrons of the restaurant will tend to regard the restaurant as a stand alone establishment without the presumption that the food and service is of perceived hotel restaurant quality.

SUMMARY OF THE INVENTION

The present invention is directed to a restaurant and hotel combination which gives patrons the impression that the restaurant and hotel are separate, distinct, and independent from one another. However, the restaurant and hotel are in fact interconnected and share a common area such that the efficiencies and economies of a single unit hotel and restaurant are provided. Various characteristics and features of the present invention may be employed to further enhance the perception of separateness and the economies of the combination.

More particularly, the present invention is directed to a restaurant and hotel combination including a restaurant structure and a hotel structure. The restaurant structure includes a dining area and defines a substantially rectangular restaurant footprint. The hotel structure includes a lobby area and a plurality of guest rooms. The hotel structure defines a substantially rectangular hotel footprint. Each of the restaurant and hotel footprints has exactly one respective corner thereof overlapping the respective corner of the other. An overlap area is thereby defined. The overlap area is positioned within each of the restaurant and hotel footprints.

Preferably, the overlap area is no greater than 30% of the restaurant footprint. More preferably, the overlap area makes up from about 5% to about 20% of the restaurant footprint.

In a preferred embodiment, the hotel structure includes a hotel front wall forming a side of the hotel footprint and the restaurant structure includes a restaurant front wall forming a side of the restaurant footprint. The hotel front wall and the restaurant front wall are spaced from one another and are non-adjacent. The restaurant and hotel combination further includes a hotel main entrance positioned along the hotel front wall and a restaurant entrance positioned along the restaurant front wall. The hotel and restaurant entrances are spaced apart and accessible from different sides of the restaurant and hotel combination. Patrons are thereby given the impression that the restaurant and hotel structures are separate and distinct from one another.

Preferably, a kitchen area is located in the restaurant structure adjacent the overlap area, and a corridor is located in the overlap area and connects the kitchen area and the hotel structure. Further, a banquet area may be provided in the hotel structure adjacent the overlap area. The corridor connects the kitchen area to the banquet area.

Moreover, in a preferred embodiment, the hotel structure includes a first floor and multiple upper floors overlying the first floor. The restaurant structure includes at least a first floor. Only the first floor of the restaurant structure is disposed immediately adjacent the hotel structure. The restaurant structure may further include a second floor overlying the first floor of the restaurant structure. The second floor is spaced apart from the hotel structure.

To further enhance the perception of separateness, the restaurant and hotel structures are preferably of substantially different architectural styles.

The preceding and further objects of the present invention will be appreciated by those of ordinary skill in the art from a reading of the figures and the detailed description of the preferred embodiment which follow, such description being merely illustrative of the present invention.

BRIEF DESCRIPTION OF THE DRAWINGS

FIG. 3 is a side elevational, schematic view of the hotel and restaurant combination; and FIG. 4 is a perspective view of the hotel and restaurant combination.

DETAILED DESCRIPTION OF THE PREFERRED EMBODIMENTS

Figure 1:
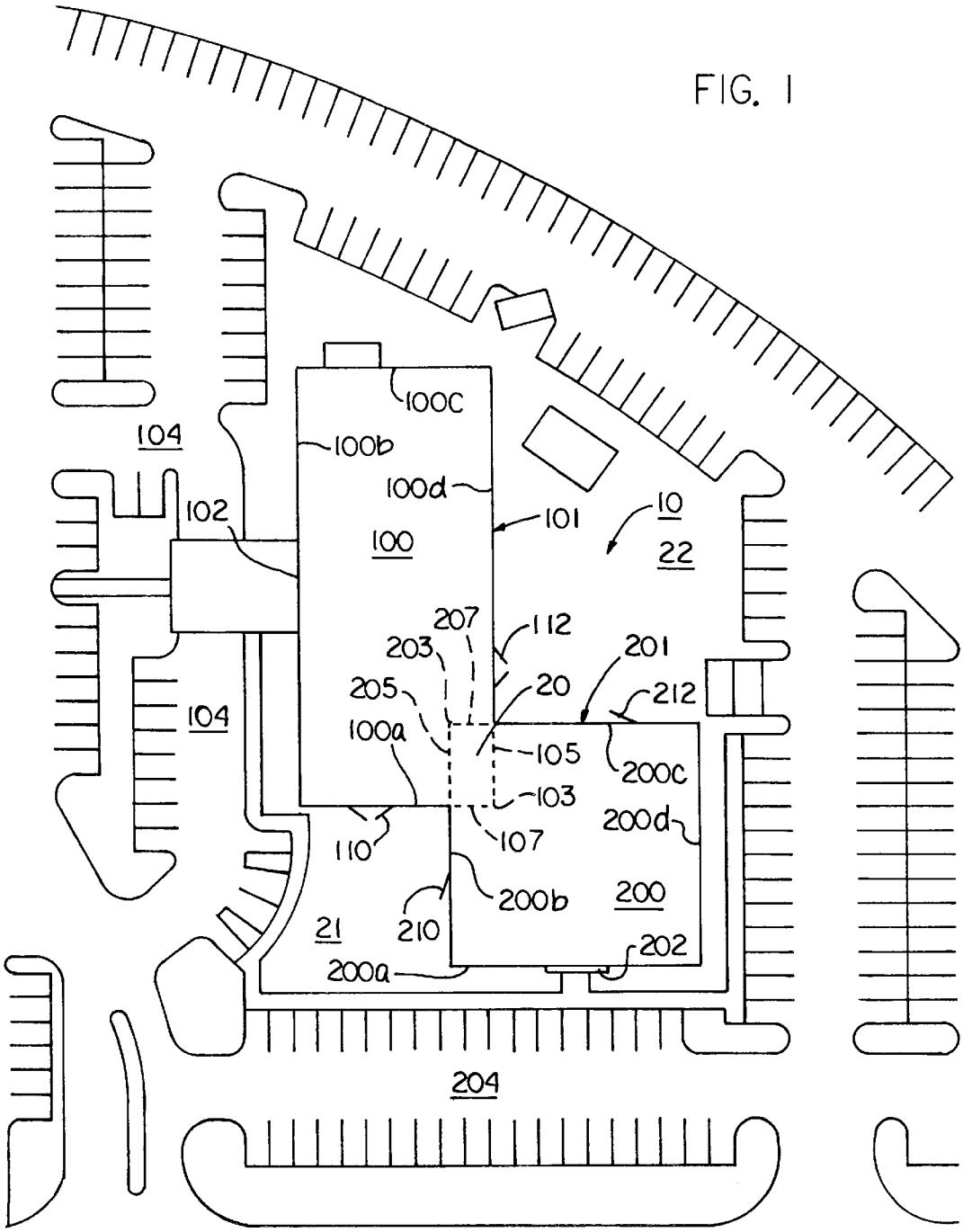
FIG. 1 is a plan, schematic view of a hotel and restaurant combination according to the present invention.

With reference to FIG. 1, a combined restaurant and hotel according to the present invention is shown therein and generally denoted by the numeral 10. Combination structure 10 includes substantially rectangular hotel structure 101 and substantially rectangular restaurant structure 201. Hotel structure 101 has a lobby area (see FIG. 2) on the first floor thereof and a plurality of guest rooms (not shown) on at least the upper floors thereof. Restaurant structure 201 has a dining area 220 (see FIG. 2).

Hotel structure 101 defines a substantially rectangular hotel footprint 100 bounded by legs 100A, 100B, 100C, 100D which correspond to the outer walls of hotel structure 101, and imaginary lines 105 and 107 which are extensions of legs 100A and 100D, respectively. Lines 105 and 107 terminate at corner 103. Similarly, substantially rectangular restaurant footprint 200 is defined by legs 200A, 200B, 200C, 200D which correspond to the outer walls of restaurant structure 201, and imaginary lines 205 and 207 which are extensions of legs 200B and 200C, respectively. Lines 205 and 207 terminate at corner 203.

Hotel footprint 100 and restaurant footprint 200 thereby overlap to form overlap area 20 defined by lines 105, 107, 205, and 207. The size of overlap area 20 should be no greater than 30% of the size of restaurant footprint 200. Preferably, overlap area 20 is from about 5 to 20% of footprint 200. More preferably, the overlap is from about 6 to 10%. The larger the overlap area in relation to the restaurant structure, the less the impression of separateness and distinctiveness. The smaller the overlap, the less area present to realize the desired efficiencies of the shared space. The specified ranges have been determined to provide a preferred compromise between these competing concerns.

Main entrance 102 (preferably including a porte cochère) for hotel structure 101 is positioned along leg 100B which corresponds to the front outer wall of the hotel structure. Main entrance 202 for restaurant structure 201 is positioned along leg 200A corresponding to the front wall of the restaurant. The hotel structure is provided with parking 104 adjacent hotel main entrance 102. The restaurant structure is provided with parking 204 adjacent main entrance 202 of the restaurant. Accordingly, the entrances and associated parking areas for hotel structure 101 and restaurant structure 201 are physically, conceptually, and intuitively spaced apart. As a result, different "centers of gravity" are created for each structure and a preferred flow of foot and automobile traffic is encouraged.

Optionally, the hotel and restaurant structures may share a courtyard 21 accessible by secondary doors 110, 210. Further, the hotel and restaurant structures may share a garden area 22 accessible by secondary doorways 112, 212.

Various advantages of the above described combination restaurant and hotel of the present invention will be appreciated by those of ordinary skill in the art upon a reading of the foregoing. The hotel main entrance is separated dramatically from the restaurant and the restaurant main entrance. Separate parking is provided which is clearly delineated by the placement of the respective main entrances so that the "freestanding" impression is enhanced and parking attendants are not needed to ensure that patrons park near their intended destination. Preferably, the hotel and restaurant designs and architectures are different from each other, yet complimentary, thereby further creating an image in the minds of the public that the restaurant and hotel are separate entities. For example, as generally shown in FIG. 4, the hotel may be in the arts and crafts movement or Frank Lloyd Wright prairie style with the restaurant adopting a Tuscan villa style.

Overall, the present invention allows the restaurant to be essentially "freestanding" from the hotel, yet attached thereto in a critical and logistically advantageous way. Freestanding restaurants are known to generate higher sales than "inline" or "attached" restaurants. The present invention has the advantage of appearing freestanding, while still having the advantages of being attached. The relationship between the hotel's banquet and meeting rooms with the restaurant's kitchen provides enhanced logistic efficiency without creating the marketing disadvantage of being "attached" to or "in" the hotel. The sharing relationship between the hotel's banquet meeting rooms and the restaurant with the courtyard provides an economic advantage by having both areas relate to the same outdoor space, minimizing the amount of outdoor space which must be created and tended.

Figure 2:
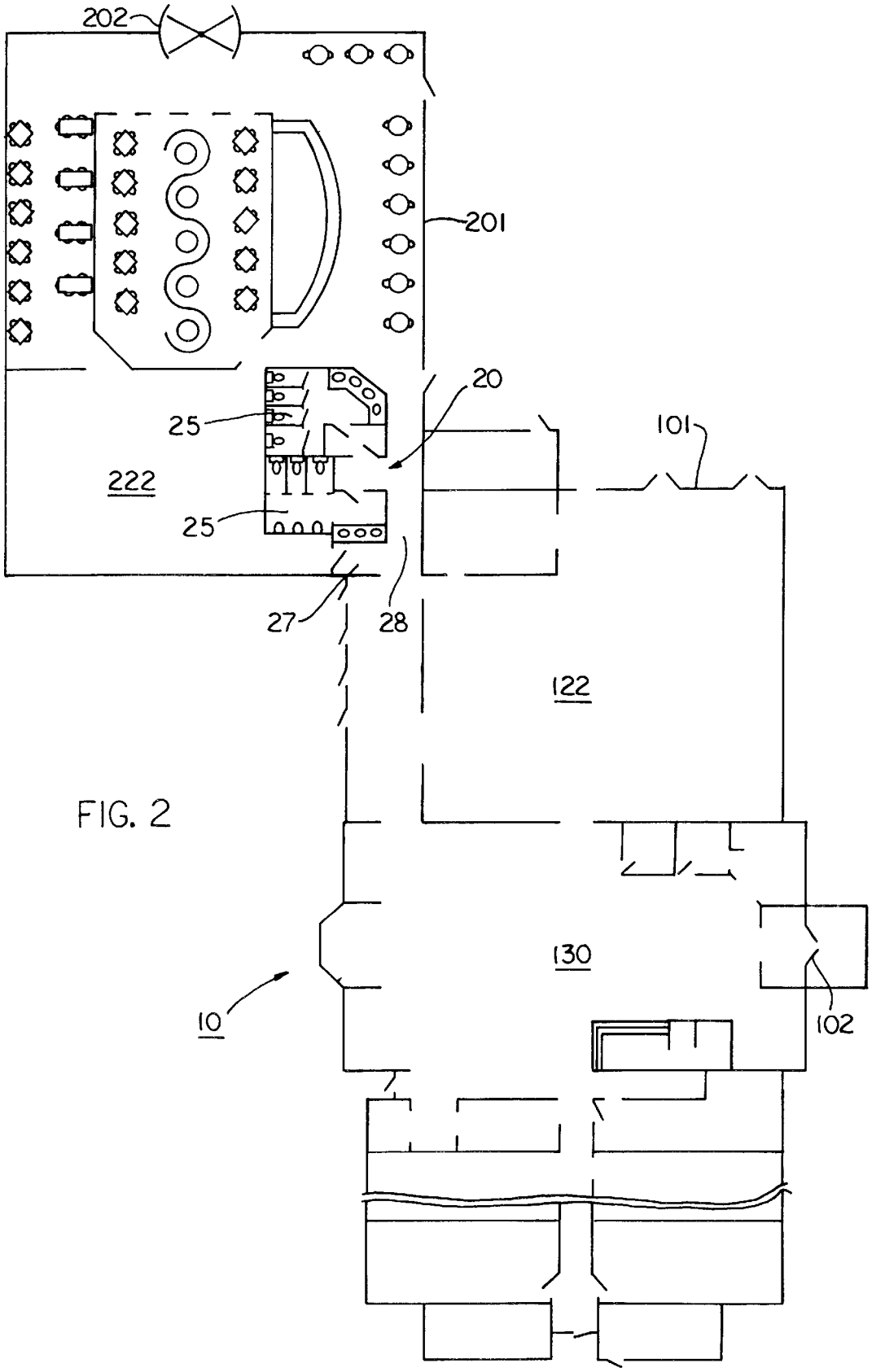
FIG. 2 is a plan, detailed view of the first floor of the hotel and restaurant combination.

Certain additional features may be incorporated into the combination hotel and restaurant which further maximize efficiencies and/or contribute to the impression that the structures are separate and independent. With reference to FIG. 2, common or overlap area 20 may include restroom facilities 25 accessible from both the restaurant and hotel, corridor 28 connecting the hotel and restaurant bar or dining area 220, and hallway 27 connecting kitchen 222 of the restaurant with the hotel. Preferably, hotel banquet rooms 122 are located adjacent overlap area 20 as is kitchen 222. It will be appreciated that this configuration maximizes the distance between the kitchen and both the banquet area and the dining area. Further, this configuration allows for a shared kitchen facility while minimizing cross traffic.

The impression that the structures are separate and distinct may be further enhanced by selectively choosing the relative heights of the hotel and restaurant structures. With reference to FIG. 3, hotel structure 101 includes first floor 141 and multiple upper floors 140. Restaurant structure 202 has first floor 241 and optionally a second floor or raised ceiling 240. In the preferred embodiment, second floor or raised ceiling portion 240 is laterally spaced apart from hotel structure 101 so that a portion 241A of first floor 241 extends from hotel structure 101 adjacent overlap area 20 to where second floor or raised ceiling 240 begins. Thus, the portion of restaurant structure 201 immediately adjacent multi-story hotel structure 101 is only a single story thereby providing a sharp contrast between these structures. Further, the provision of second floor or raised ceiling 240 of restaurant structure 201 encourages the perception that the restaurant structure is a freestanding building, particularly when the restaurant structure is of a distinctly different overall style than the hotel structure.

While a preferred embodiment of the present invention has been described, it will be appreciated by those of skill in the art that certain modifications may be made without departing from the scope of the present invention. All such modifications are intended to come within the scope of claims which follow.

What is claimed is:

1. A restaurant and hotel combination comprising:

a) a restaurant structure including a dining area and defining a substantially rectangular restaurant footprint;

b) a hotel structure including a lobby area and a plurality of guest rooms, said hotel structure defining a substantially rectangular hotel footprint;

c) wherein each of said restaurant and hotel footprints has exactly one respective corner thereof overlapping the respective corner of the other, thereby defining an overlap area which is positioned within each of said restaurant and hotel footprints;

d) wherein said overlap is accessible from each of said restaurant structure and said hotel structure such that said hotel structure is accessible from said restaurant structure through said overlap area;

e) said hotel structure including a hotel front wall forming a side of said hotel footprint and said restaurant structure including a restaurant front wall forming a side of said restaurant footprint, said hotel front wall and said restaurant front wall being spaced from one another and non-adjacent, each of said hotel front wall and said restaurant front wall facing in a different direction from the other; and f) a hotel main entrance positioned along said hotel front wall and a restaurant entrance positioned along said restaurant front wall, whereby said hotel and restaurant entrances are spaced apart and accessible from different directions and from different sides of said restaurant and hotel combination, thereby giving patrons the impression that said restaurant and hotel structures are separate and distinct from one another.

2. The restaurant and hotel combination of claim 1 wherein said overlap area is no greater than 30% of said restaurant footprint.

3. The restaurant and hotel combination of claim 2 wherein said overlap area makes up from about 5% to about 20% of said restaurant footprint.

4. The restaurant and hotel combination of claim 1 including a kitchen area located in said restaurant structure adjacent said overlap area, and a corridor located in said overlap area and connecting said kitchen area and said hotel structure.

5. The restaurant and hotel structure combination of claim 4 further including a banquet area in said hotel structure adjacent said overlap area, and wherein said corridor connects said kitchen area to said banquet area.

6. The restaurant and hotel structure combination of claim 1 wherein said hotel structure includes a first floor and multiple upper floors overlying said first floor, and said restaurant structure includes at least a first floor, and wherein only said first floor of said restaurant structure is disposed immediately adjacent said hotel structure.

7. The restaurant and hotel structure combination of claim 6 wherein said restaurant structure further includes a second floor overlying said first floor of said restaurant structure, said second floor being spaced apart from said hotel structure.

8. The restaurant and hotel structure combination of claim 1 wherein said restaurant and hotel structures are of substantially different architectural styles.

9. A restaurant and hotel combination comprising:

a) a restaurant structure including a dining area and defining a substantially rectangular restaurant footprint;

b) a hotel structure including a lobby area and a plurality of guest rooms, said hotel structure defining a substantially rectangular hotel footprint;

c) wherein each of said restaurant and hotel footprints has exactly one respective corner thereof overlapping the respective corner of the other, thereby defining an overlap area which is positioned within each of said restaurant and hotel footprints, said overlap area being no greater than 30% of said restaurant footprint;

d) wherein said overlap is accessible from each of said restaurant structure and said hotel structure such that said hotel structure is accessible from said restaurant structure through said overlap area;

e) said hotel structure including a hotel front wall forming a side of said hotel footprint and said restaurant structure including a restaurant front wall forming a side of said restaurant footprint, said hotel front wall and said restaurant front wall being spaced from one another and non-adjacent, each of said hotel front wall and said restaurant front wall facing in a different direction from the other;

f) a hotel main entrance positioned along said hotel front wall and a restaurant entrance positioned along said restaurant front wall, whereby said hotel and restaurant entrances are spaced apart and accessible from different directions and from different sides of said restaurant and hotel combination, thereby giving patrons the impression that said restaurant and hotel structures are separate and distinct from one another; and g) wherein said hotel structure includes a first floor and multiple upper floors overlying said first floor, said restaurant structure includes at least a first floor, and wherein only said first floor of said restaurant structure is disposed immediately adjacent said hotel structure.

10. The restaurant and hotel combination of claim 9 wherein said overlap area makes up from about 5% to about 20% of said restaurant footprint.

11. The restaurant and hotel combination of claim 9 including a kitchen area located in said restaurant structure adjacent said overlap area, and a corridor located in said overlap area and connecting said kitchen area and said hotel structure.

12. The restaurant and hotel structure combination of claim 11 further including a banquet area in said hotel structure adjacent said overlap area, and wherein said corridor connects said kitchen area to said banquet area.

13. The restaurant and hotel structure combination of claim 9 wherein said restaurant structure further includes a second floor overlying said first floor of said restaurant structure, said second floor being spaced apart from said hotel structure.

14. The restaurant and hotel structure combination of claim 9 wherein said restaurant and hotel structures are of substantially different architectural styles.

15. A restaurant and hotel combination comprising:

a) a restaurant structure including a dining area and defining a substantially rectangular restaurant footprint;

b) a hotel structure including a lobby area and a plurality of guest rooms, said hotel structure defining a substantially rectangular hotel footprint;

c) wherein each of said restaurant and hotel footprints has exactly one respective corner thereof overlapping the respective corner of the other, thereby defining an overlap area which is positioned within each of said restaurant and hotel footprints, said overlap area being no greater than 30% of said restaurant footprint;

d) wherein said overlap is accessible from each of said restaurant structure and said hotel structure such that said hotel structure is accessible from said restaurant structure through said overlap area; and e) wherein said hotel structure includes a first floor and multiple upper floors overlying said first floor, said restaurant structure includes at least a first floor, and wherein only said first floor of said restaurant structure is disposed immediately adjacent said hotel structure.

16. The restaurant and hotel combination of claim 15 wherein said overlap area makes up from about 5% to about 20% of said restaurant footprint.

17. The restaurant and hotel combination of claim 15 including a kitchen area located in said restaurant structure adjacent said overlap area, and a corridor located in said overlap area and connecting said kitchen area and said hotel structure.

18. The restaurant and hotel structure combination of claim 17 further including a banquet area in said hotel structure adjacent said overlap area, and wherein said corridor connects said kitchen area to said banquet area.

19. The restaurant and hotel structure combination of claim 15 wherein said restaurant structure further includes a second floor overlying said first floor of said restaurant structure, said second floor being spaced apart from said hotel structure.

20. The restaurant and hotel structure combination of claim 15 wherein said restaurant and hotel structures are of substantially different architectural styles.

* * * * *